United States Patent [19]

Küpper

[11] 4,213,290

[45] Jul. 22, 1980

[54] RING SPINNING FRAME WITH DRAWING MECHANISM STOP MOTION

[75] Inventor: Wilhelm Küpper, Wegberg, Fed. Rep. of Germany

[73] Assignee: W. Schlafhorst & Co., Monchen-Gladbach, Fed. Rep. of Germany

[21] Appl. No.: 934,678

[22] Filed: Aug. 18, 1978

[30] Foreign Application Priority Data

Aug. 20, 1977 [DE] Fed. Rep. of Germany ..... 2737599

[51] Int. Cl.[2] ..... D01H 13/16

[52] U.S. Cl. ..... 57/85; 57/87

[58] Field of Search ..... 57/83–87, 57/34 R, 261–265

[56] References Cited

U.S. PATENT DOCUMENTS

| | | | |
|---|---|---|---|
| 972,266 | 10/1910 | Sharp | 57/85 |
| 1,525,004 | 2/1925 | Sharp | 57/85 |
| 1,815,743 | 7/1931 | Stutz-Benz | 57/87 X |
| 2,019,673 | 11/1935 | Gow | 57/87 X |
| 3,751,896 | 8/1973 | Ford | 57/87 |
| 4,000,603 | 1/1977 | Lee, Jr. | 57/87 |
| 4,030,281 | 6/1977 | Schopper et al. | 57/87 |

*Primary Examiner*—John Petrakes

*Attorney, Agent, or Firm*—Herbert L. Lerner

[57] ABSTRACT

Ring spinning machine includes a drawing frame having, at a given location therein, a draw-up roll for drawing therethrough in a given direction a roving being spun into a thread, and a roving-clamping device responsive to a break in the thread for clamping the roving, the roving-clamping device being controllably deflectable transversely to the given drawing direction in vicinity of the given location.

5 Claims, 3 Drawing Figures

RING SPINNING FRAME WITH DRAWING MECHANISM STOP MOTION

Figure 1:
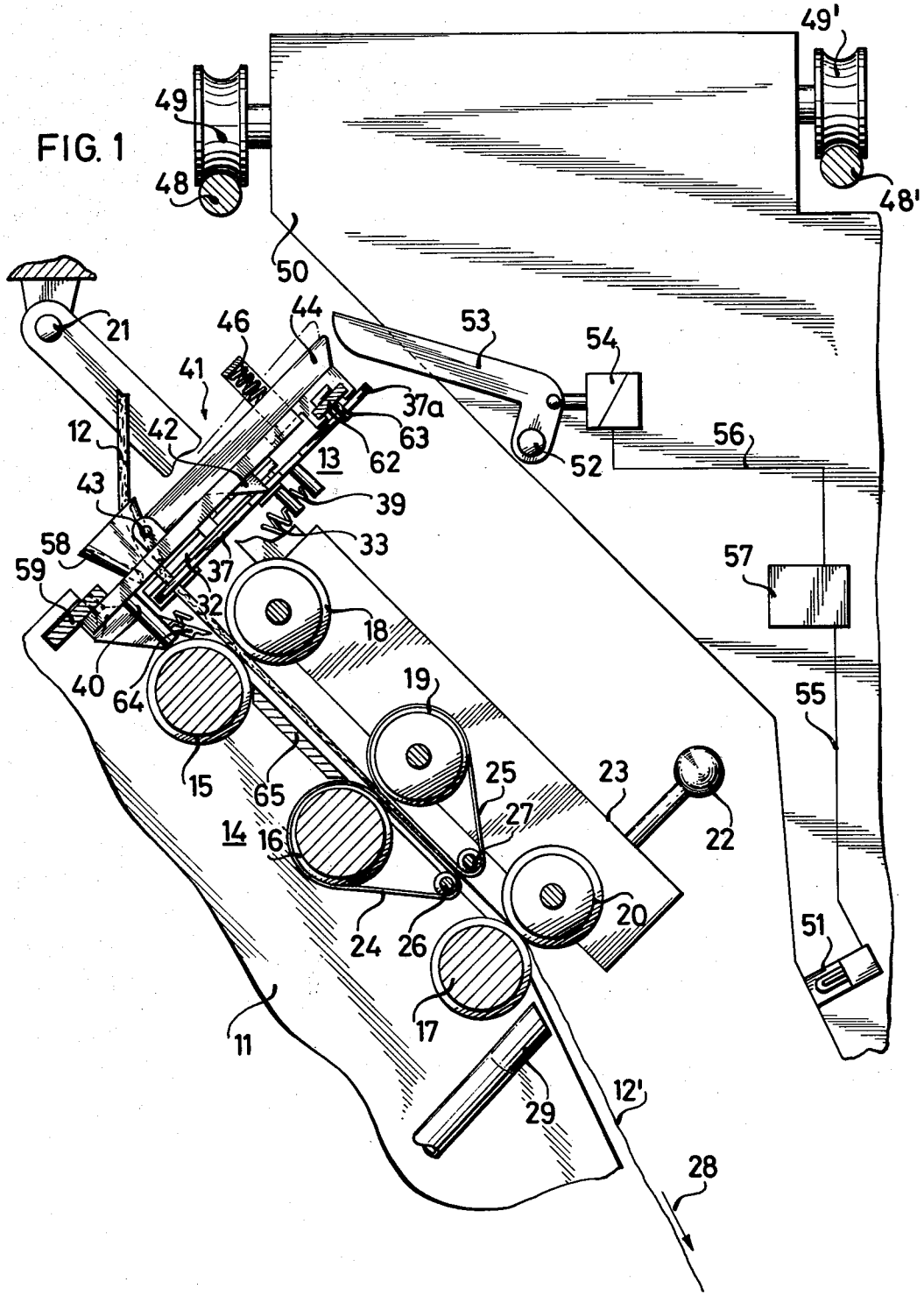

The invention relates to a ring spinning frame or machine with a drawing frame and a roving-clamping device responsive to a thread break.

In a ring spinning machine with drawing frame, as is generally well known, the previously stretched or drawn roving leaving the drawing frame is taken up by a suction tube when a thread breaks. By immediately sucking away the roving, lap formation in the drawing frame is to be prevented. It has been proposed heretofore to provide a traveling roving-clamping device responsive to a thread break. This clamping device clamps the roving ahead or upstream of the drawing frame, in travel direction of the roving, and firmly holds it temporarily so that it is broken or torn off ahead of the feed roll of the drawing frame, whereupon the traveling device releases the clamped roving end and moves on. A disadvantage arises therefrom in that the roving cannot run into the drawing frame again automatically for starting up the spinning station. Another disadvantage is that the roving end can attach itself unintentionally, for example, due to air movement, to the roving of an adjacent spinning station and can cause disturbances there.

It is accordingly an object of the invention to provide a ring spinning machine and drawing frame with a roving-clamping device responsive to a thread break which permits the roving to run into the drawing frame automatically, after the roving-clamping device is released, for the purpose of restarting the ring spinning machine, thereby avoiding the aforementioned disadvantages, of the heretofore known machines of this general type.

With the foregoing and other objects in view, there is provided in accordance with the invention, a ring spinning machine comprising therein a drawing frame having, at a given location, a draw-up roll for drawing therethrough in a given direction a roving being spun into a thread, and a roving-clamping device responsive to a break in the thread for clamping the roving, the roving-clamping device being controllably deflectable transversely to the given drawing direction in vicinity of the given location. This roving-clamping device seizes the roving ahead or upstream of the draw-uup or drawing-in roll, in travel direction of the roving, and deflects it simultaneously to the side or, alternatively, to the front or rear, so that it is removed from the vicinity of the draw-up roll of the drawing frame. Thereafter, the roving breaks behind or downstream of the clamping location. After the return and release of the roving-clamping device, the broken or torn-off end of the roving, under the influence of gravity or by means of blown air, automatically comes back into the draw-up or drawing-in region of the draw-up roll again.

In accordance with another feature of the invention, the roving clamping device is latchable in made-ready position thereof and has an unlatching device responsive to a thread break.

It is not always necessary to release the clamping operation immediately when a thread break occurs. Devices which travel along the ring spinning machine and monitor the spinning stations for thread breaks and, in the event of a thread break, perform or initiate the actions necessary in such an event, have become known heretofore. Therefore, in accordance with a further feature of the invention, a device for monitoring the spinning machine for thread breaks and which either travels along the ring spinning machine or is stationary is provided, the unlatching device being releasable by the monitoring device. This monitoring device can, additionally, count the number of thread breaks on one machine side and issue a signal for the operator that is manually cancelable, as soon as a given number of thread breaks has been counted. Such signals, provided at an advantageous observation point, indicate to the operating personnel the priority at which yarn breaks must be corrected at the respective machine sides. As long as no such signal is set, the individual spinning stations need not be checked. This saves time and motion.

In accordance with an added feature of the invention, the roving-clamping device comprises a two-part clamp including a lower clamping member spring-biased into made-ready position thereof and an upper clamping member held by the unlatching device in made-ready position against a spring-biasing force, the upper clamping member, after unlatching of the roving-clamping device, pressing the roving against the lower clamping member and deflecting both the roving and the lower clamping member transversely to the given drawing direction, and including stop means for limiting the deflection of the roving and the lower clamping member.

In accordance with concomitant features of the invention, the ring spinning machine has a plurality of spinning stations, and includes a remote setting device for latching respective roving-clamping devices of at least several of the plurality of spinning stations jointly in made-ready position or for jointly releasing rovings clamped by respective roving-clamping devices of at least several of the plurality of spinning stations. Thread piecing or joining is thereby accelerated. The remote setting device is advantageously disposed so that the roving-clamping devices can also be latched individually and manually which, in the case of individual joining or piecing at the spinning stations, causes less waste and therefore produces advantages.

Further advantages derived from the invention are that if any disturbance of the spinning operation should occur, a minimum of material to be spun is sucked into the waste can; roll laps of objectionable size are prevented from forming in the drawing frame; the roving end remains fixed and therefore cannot interfere with adjacent spinning stations; and, when restarting the spinning operation i.e. when joining or piecing, the roving again runs automatically into the drawing frame, so that release of the roving ends can be effected in common for several or all spinning stations of a machine side, by remote control.

Other features which are considered as characteristic for the invention are set forth in the appended claims.

Although the invention is illustrated and described herein as embodied in a ring spinning frame with drawing mechanism, it is nevertheless not intended to be limited to the details shown, since various modifications and structural changes may be made therein without departing from the spirit of the invention and within the scope and range of equivalents of the claims.

Figure 2:
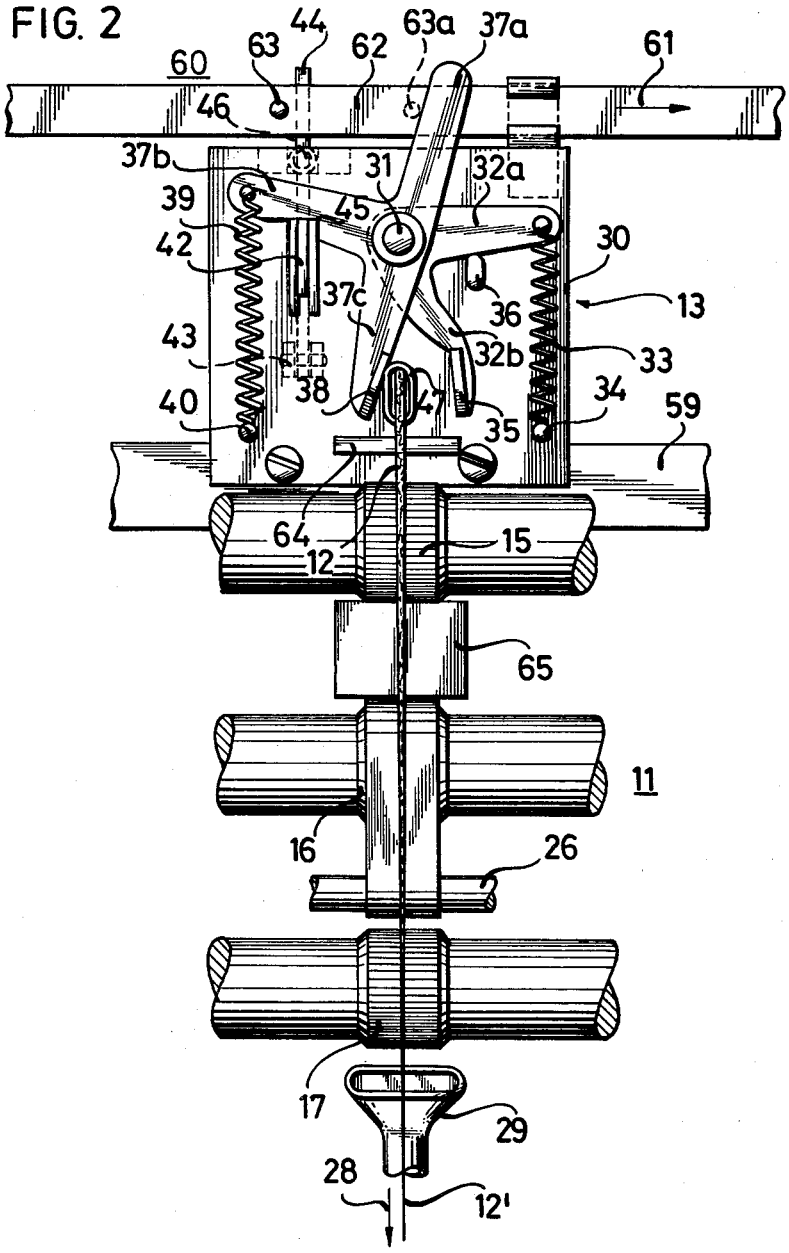
Figure 3:
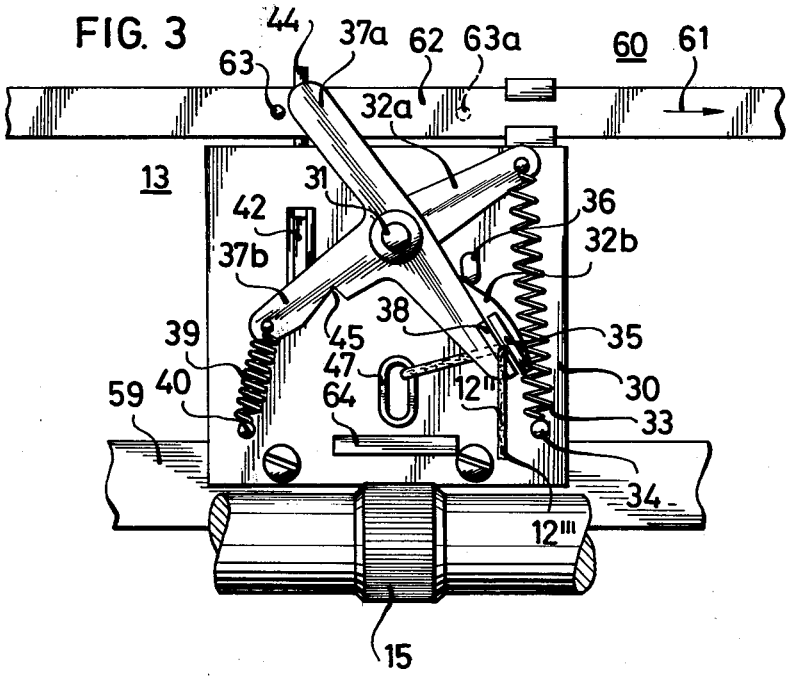

The construction and method of operation of the invention, however, together with additional objects and advantages thereof will be best understood from the following description of specific embodiments when read in connection with the accompanying drawings, in which:

FIG. 1 is a side elevational view, partly cut away, of a spinning station of a ring spinning machine;

FIG. 2 is a fragmentary front elevational view of FIG. 1, with the device at the right-hand side thereof and the hinged support in the middle thereof omitted and showing a swung-out drawing frame at this spinning station in an operating phase thereof before a roving-clamping device has responded, in the interest of clarity, the drawing frame and the roving-clamping device being folded into the plane of the drawing; and FIG. 3 is a slightly enlarged fragmentary view of FIG. 2 showing the roving-clamping device in an operating phase thereof after it has responded.

Referring now to the figures of the drawing, there is shown therein a spinning station 11 of an otherwise non-illustrated ring spinning machine. A roving 12 is fed to a drawing frame 14 from above by means of a roving-clamping device 13. In the drawing frame 14 three directly driven rolls are shown, namely, a draw-up or drawing-in roll 15, a middle roll 16 and a withdrawal or delivery roll 17. Also shown are three rolls indirectly driven by friction, namely a respective draw-up or drawing-in roll 18, a middle roll 19 and a withdrawal or delivery roll 20. By means of a support 23 pivotable about a pivot pin 21 and actuatable by a handle 22, the indirectly driven rolls 18 to 20 are shiftable into engagement with the directly driven rolls 15 to 17 or lifted away therefrom. Endless belts 24 and 25, respectively, are disposed about the directly driven roll 16 and the indirectly driven roll 19 and are maintained in tension by tightening or tension rolls 26 and 27, respectively.

The roving drawn out into a thread 12' leaves the combination of the directly driven withdrawal roll 17 and the indirectly driven withdrawal roll 20 in the direction of the arrow 28 and is fed to an otherwise non-illustrated ring bank of the ring spinning machine. The thread 12' is led past a suction tube 29, through which air is continuously drawn into a non-illustrated container.

The roving-clamping device 13 disposed above the drawing frame 14 is made up of the following parts, as is especially apparent from FIG. 2.

On a base plate 30 fastened to a reciprocating roving guide 59, there is fastened a pin 31, on which a two-arm lever or bell crank 32 with lever arms **32*a* and 32*b* is pivotally mounted. At the end of the lever arm 32*a*, a spring eye is formed into which one end of a spring 33 is hooked, the other end of the spring 33 being connected to a spring attachment pin 34 fastened to the base plate 30**.

A lower clamping member 35 is located at the end of the lever arm **32*b*. The two-arm lever or bell crank 32 is held in the position thereof by a stop 36. Above the bell crank 32 is a three-arm lever 37 likewise pivotally mounted on the pin 31. The three-arm lever 37 has lever arms 37*a*, 37*b* and 37*c*. The end of the lever arm 37*c* is constructed as an upper clamping member 38 which cooperates with the lower clamping member 35. The lever arm 37*b* is provided with a spring eye, from which a spring 39 is suspended by one end thereof, the other end of the spring 39 being connected to a spring attachment pin 40 fastened to the base plate 30. The springs 33 and 39 are tension springs, the spring 39 being significantly stronger than the spring 33**.

The three-arm lever 37 is held in position thereof by an unlatching device 41. This unlatching device is made up of a latch 42 which is pivotable about a pivot pin 43 and is actuatable by a lever 44. The latch 42 engages in a cutout 45 formed in the lever arm **37*b*. The latch 42 is held in position thereof by a compression spring 46 acting upon the lever 44**.

The roving 12 passes through the base plate 30 through an opening 47 formed therein and preceded by a funnel 58. The opening 47 serves simultaneously as a thread guide.

It is apparent from FIG. 2 that the lever 44 must be swung to the rear about the pivot pin 43 to operate the unlatching device 41. Then the latch 42 slides out of the cutout 45, and the three-arm lever 37 turns counterclockwise, as viewed in FIG. 2, under the applied force of the spring 39. The upper clamping member 38 accordingly seizes the roving 12, deflects it to the right-hand side, as viewed in FIG. 2, clamps it against the lower clamping member 35 and also deflects the two-arm lever or bell crank 32 counterclockwise until the lower clamping member 35 has the position thereof shown in FIG. 3. In the latter position of the roving-clamping device 13, the roving 12 assumes the position 12" and breaks at the location 12'''. The stop 36 which, may also be adjustable, limits the possible movement of the lever arm **32*b* and thereby also the movement of the three-arm lever 37**.

To set the spinning station in operation again, the lever arm **37*a* is manually swung back clockwise, as viewed in FIG. 3, until the latch 42 of the unlatching device 41 again snaps into the cutout 45 of the lever arm 37*b*. During this movement, the two-arm lever or bell crank 32 also returns to the starting position thereof under the biasing force of the spring 33. The latching can also be effected in common for several spinning stations by a remote setting device 60 formed of a bar 62 displaceable in direction of the arrow 61, with entrainers 63 for each spinning station fastened thereto. As soon as the entrainer 63 has reached the position 63*a*, the latch 42 is again detented or engaged. The entrainers 63** can be activated at any desired number of roving-clamping devices, so that all these clamping devices can be brought simultaneously into made-ready or standby position and latched.

In FIG. 1 above the spinning station 11, there are located rails 48 and 48' on which rolls 49 and 49' of a device 50 for monitoring the spinning stations for thread breaks are guided so that the device 50 runs along the ring spinning machine. The device 50 is disposed in a space below a non-illustrated roving creel and above the drawing frame 14, and has a thread sensor 51, by means of which there is determined whether or not a thread is present at the spinning station behind the drawing frame 14. In the upper part of the device 50, there is provided a pivot 52, about which a control lever 53 is pivotable. The control lever 53 can be turned by an electromagnet 54 in a conventional manner.

If the device 50 determines that, for example, at the spinning station 11 behind the drawing frame 14, a thread is no longer present, a fault alarm is sent over a line 56 to a switching device 57 which, thereupon, sends an actuating current over a line 56 to the electromagnet 54. The electromagnet 54 turns the switching lever 53 counterclockwise, as viewed in FIG. 1, so that it swings the lever 44 of the unlatching device 41 counterclockwise about the axis 43. This causes the unlatching of the roving-clamping device 13, which results in the immediate deflection, clamping and subsequent tearing-off or breaking of the roving. From this instant on, no windings can be formed any more on the rotating parts of the drawing frame 14.

To make-ready for the joining or piecing operation, the lever arm 37*a* is swung back into the made-ready or standby position thereof, during which the clamped roving end is released and is engaged by the directly driven draw-up roll 15, the plates 64 and 65 guiding the roving and preventing it from falling down. In the made-ready or standby position, the latch 42 automatically engages in the cutout 45 of the lever arm 37*b*. The roving-clamping device 13 is thereby again latched in the standby or made-ready position thereof, as is shown in FIGS. 1 and 2.

There are claimed:

1. Ring spinning machine comprising a drawing frame having, at a given location therein, a draw-up roll for drawing therethrough in a given direction a roving being spun in a thread, and a roving-clamping device responsive to a break in the thread for clamping the roving, said roving-clamping device being controllably deflectable to move the roving transversely to said given drawing direction in vicinity of said given location, said roving-clamping device being latchable in made-ready position thereof, having an unlatching device responsive to a thread break and comprising a two-part clamp including a lower clamping member spring-biased into made-ready position thereof and an upper clamping member held by said unlatching device in made-ready position against a spring-biasing force, said upper clamping member, after unlatching of said roving-clamping device, pressing the roving against said lower clamping member and deflecting both the roving and said lower clamping member transversely to said given drawing direction, and including stop means for limiting the deflection of the roving and said lower clamping member.

2. Ring spinning machine according to claim 1 including a device for monitoring the spinning machine for thread breaks, said unlatching device being releasable by said monitoring device.

3. Ring spinning machine according to claim 2 having a plurality of spinning stations, said monitoring device being drivable along the ring spinning machine for monitoring the plurality of spinning stations for thread breaks.

4. Ring spinning machine according to claim 1 having a plurality of spinning stations, and including a remote setting device for latching respective roving-clamping devices of at least several of the plurality of spinning stations jointly in made-ready position.

5. Ring spinning machine according to claim 1 having a plurality of spinning stations, and including a remote setting device for jointly releasing rovings clamped by respective roving-clamping devices of at least several of the plurality of spinning stations.

* * * * *